US008025022B1

(12) United States Patent
Morris

(10) Patent No.: US 8,025,022 B1
(45) Date of Patent: Sep. 27, 2011

(54) PAINTING DEVICE

(76) Inventor: LaMont C. Morris, Cumberland, RI (US)

( * ) Notice: Subject to any disclaimer, the term of this patent is extended or adjusted under 35 U.S.C. 154(b) by 169 days.

(21) Appl. No.: 12/501,641

(22) Filed: Jul. 13, 2009

(51) Int. Cl.

| | |
|---|---|
| ***B05C 1/06*** | (2006.01) |
| ***B05C 1/08*** | (2006.01) |
| ***B05C 11/00*** | (2006.01) |
| ***B05C 17/02*** | (2006.01) |
| ***A46B 17/00*** | (2006.01) |
| ***A47L 13/00*** | (2006.01) |

(52) U.S. Cl. .... 118/258; 118/264; 15/248.2; 15/230.11; 15/236.03

(58) Field of Classification Search ..... 15/248.2, 15/230.11, 236.03; 118/258, 264
See application file for complete search history.

(56) References Cited

U.S. PATENT DOCUMENTS

| | | | | |
|---|---|---|---|---|
| 4,402,102 | A * | 9/1983 | Al-samman | 15/230.11 |
| 4,528,712 | A * | 7/1985 | Leibow | 15/118 |
| 5,014,384 | A * | 5/1991 | Brezette et al. | 15/230.11 |
| 5,432,972 | A * | 7/1995 | Polzin et al. | 15/210.1 |

* cited by examiner

*Primary Examiner* — Dah-Wei Yuan
*Assistant Examiner* — Stephen Kitt
(74) *Attorney, Agent, or Firm* — Salter & Michaelson

(57) ABSTRACT

A painting device for applying a paint product and that includes a frame with a handle end and a support end and that has one and another sides. The one side of the support end of the frame includes spaced apart flanges that retain therebetween a paint roller and the another side of the support end of the frame includes a wall member and opposed end wall surfaces that together retain a paint pad device.

13 Claims, 10 Drawing Sheets

PAINTING DEVICE

TECHNICAL FIELD

The present invention relates in general to a painting device and pertains, more particularly, to an improved painting device that incorporates in an integral manner both a paint roller and paint pad.

BACKGROUND OF THE INVENTION

At the present time there exists a number of different implements for assisting in painting, particularly in the interior of housings or buildings. These existing devices include, for example, a standard roller arrangement or a separate pad structure that is sometimes used for edging. However, a more universal painting device does not exist at the present time that can readily incorporate both the roller and pad functions.

Accordingly, it is an object of the present invention to provide an improved painting device and in particular one that integrally arranges for the use of both a roller and a pad structure.

Another object of the present invention is to provide an improved painting device that is relatively simple in construction, that is relatively easy to manufacture and that can be manufactured relatively inexpensively.

Still another object of the present invention is to provide an improved painting device that includes a preferred single handle and yet can be readily moved into different positions for either a roller action or a pad action.

SUMMARY OF THE INVENTION

To accomplish the foregoing and other objects, features and advantages of the present invention there is provided a painting device for applying a paint product and comprising: a frame that includes a handle end and a support end that has one and another sides; the one side of the support end of the frame including spaced apart flanges that retain therebetween a paint roller and the another side of the support end of the frame including a wall member and opposed end wall surfaces that together retain thereon a paint pad means.

In accordance with other aspects of the present invention the flanges each have a hole therein for receiving end posts of the paint roller; including, on the one side of the support end, a tapered wall surface that is contiguous with the handle and to which are attached the spaced apart flanges at end thereof; wherein the tapered wall surface has a top end that extends between the flanges and a smaller bottom end that merges with the handle; wherein the paint pad means comprises a base and a paint absorption layer attached to the base; wherein the base and paint absorption layer both include a right angle bend forming respective back and side pad sections; wherein the back pad section is for support against a back of the wall member and the side pad section is for support against an end wall surface; wherein the paint pad means comprises a pair of paint pads, each including a right angle bend forming respective back and side pad sections; wherein each paint pad has end engagement ribs, one rib on a free end of the back pad section and another rib on a free end of the side pad section; wherein the wall member has a central aperture for receiving respective one ribs of the pair of paint pads at opposed side edges of the aperture; wherein the opposed end wall surfaces of the support end of the frame each have engagement ledges for receiving respective another ribs of the side pad sections; wherein the paint pad means comprises a pair of paint pads, each including a right angle bend forming respective back and side pad sections, and the wall member has a central aperture for receiving respective ends of the pair of paint pads at opposed side edges of the aperture and wherein the opposed end wall surfaces of the support end of the frame each have engagement ledges for receiving respective free ends of the side pad sections.

In accordance with another version of the present invention there is provided a painting device of claim for applying a paint product and comprising: a frame that includes a handle end and a support end that has one and another sides; the one side of the support end of the frame including means for retain therebetween a paint roller and the another side of the support end of the frame including wall means for retaining thereon a paint pad member.

In accordance with other aspects of the present invention the means for retaining the paint roller comprises a pair of spaced apart flanges; wherein the means for retaining the paint pad member comprises an interlock means between the pad member and wall means; wherein the paint pad member comprises a pair of paint pads, each including a right angle bend forming respective back and side pad sections; wherein each paint pad has end engagement ribs, one rib on a free end of the back pad section and another rib on a free end of the side pad section; wherein the wall member has a central aperture for receiving respective one ribs of the pair of paint pads at opposed side edges of the aperture and wherein the opposed end wall surfaces of the support end of the frame each have engagement ledges for receiving respective another ribs of the side pad sections.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
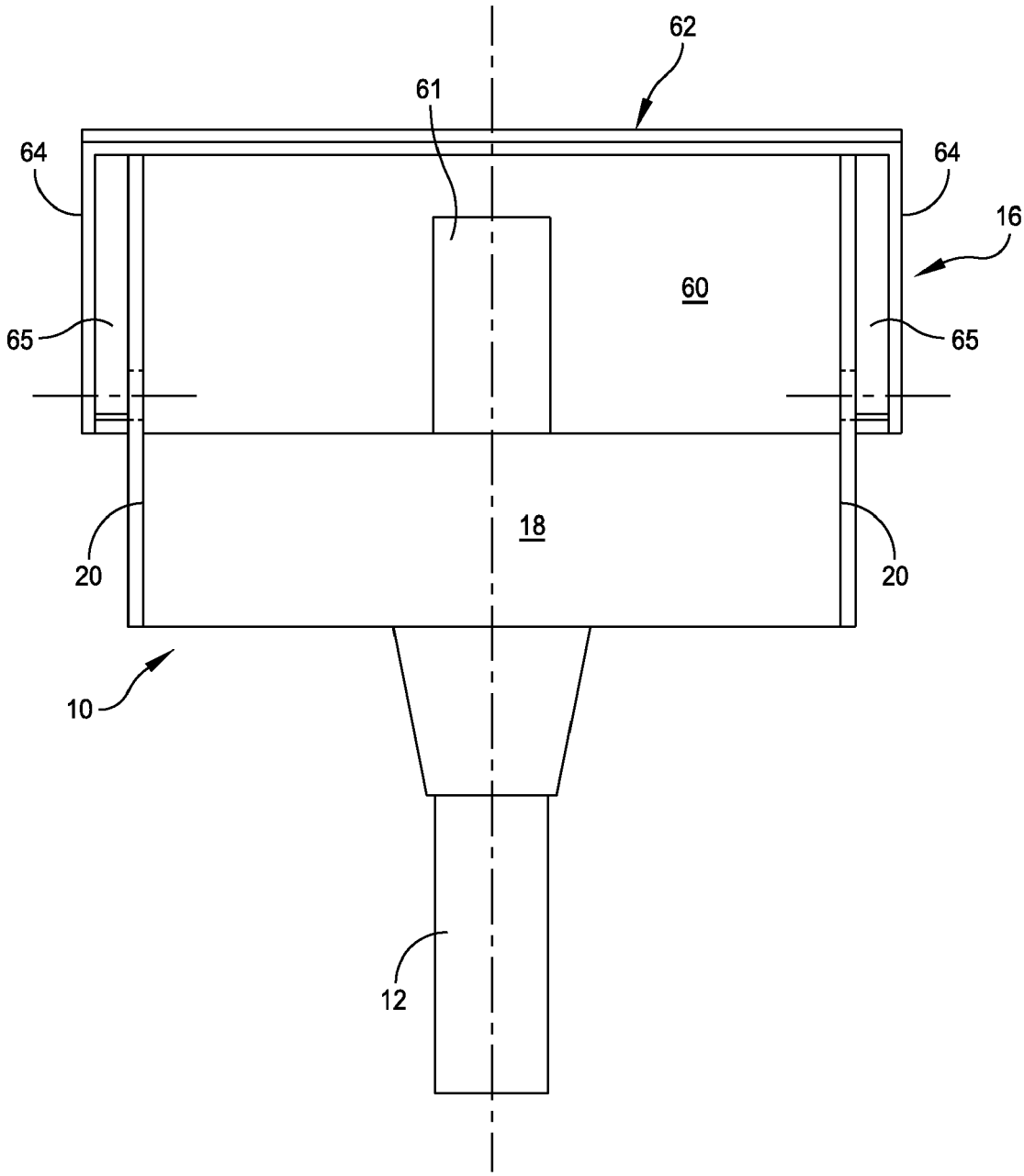
FIG. 1 is a front view of a preferred embodiment of the roller device frame.
Figure 2:
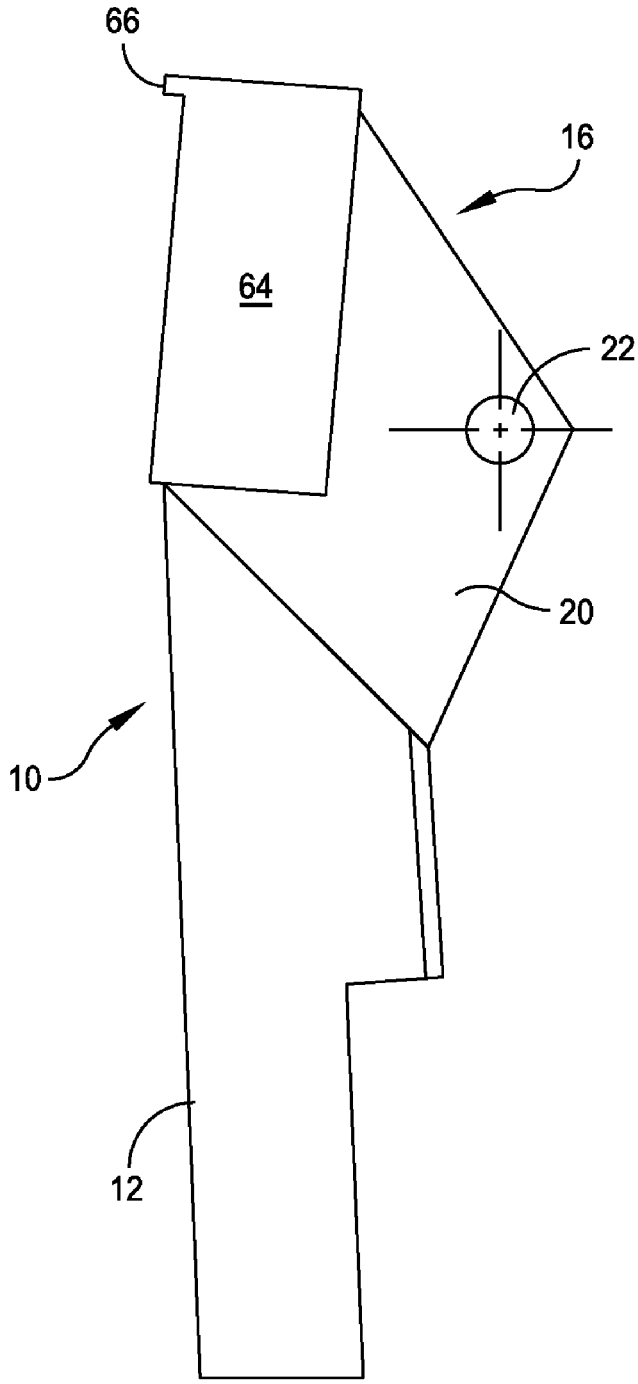
FIG. 2 is a left side view of the roller device frame.
Figure 3:
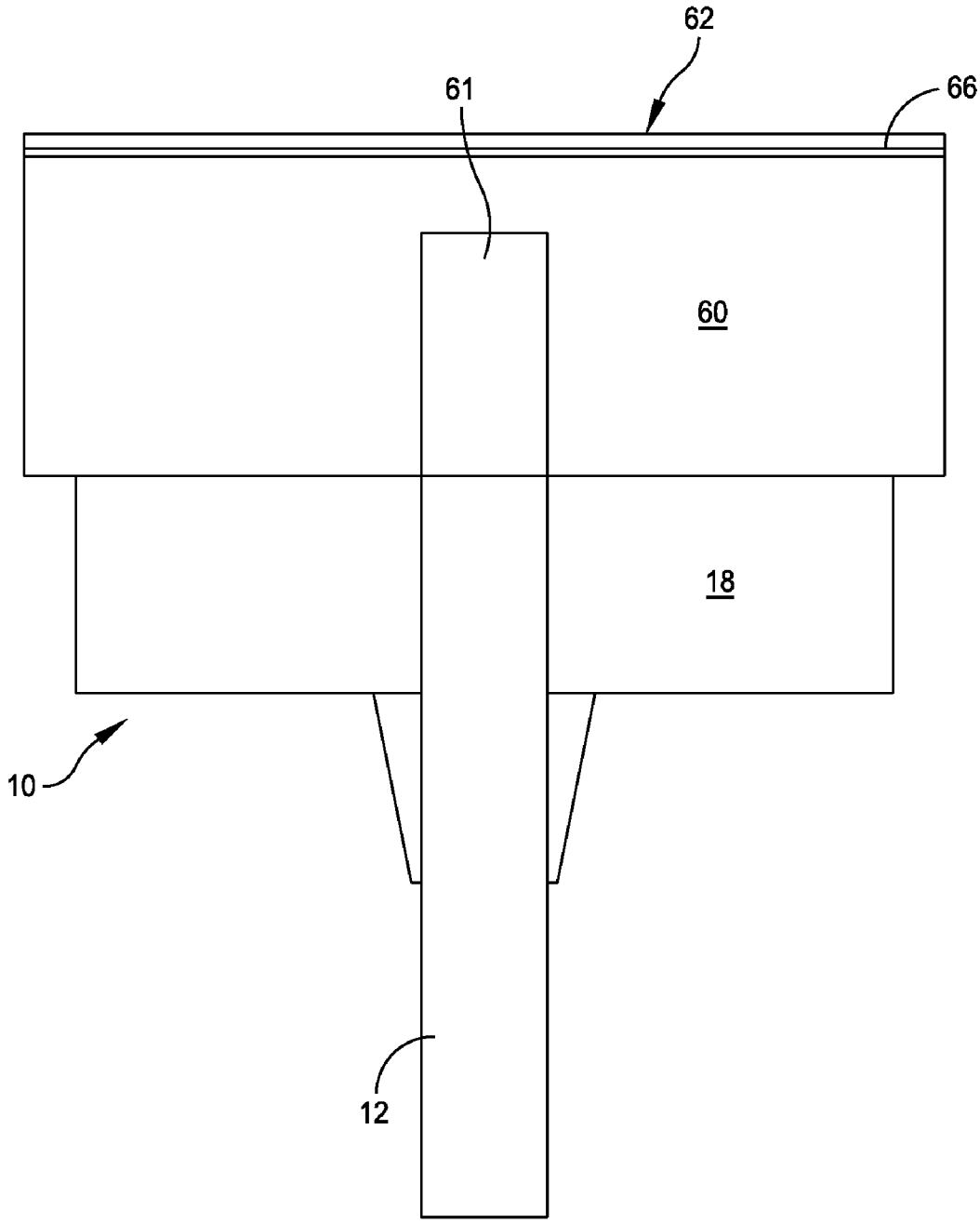
FIG. 3 is a rear view of the roller device frame.
Figure 4:
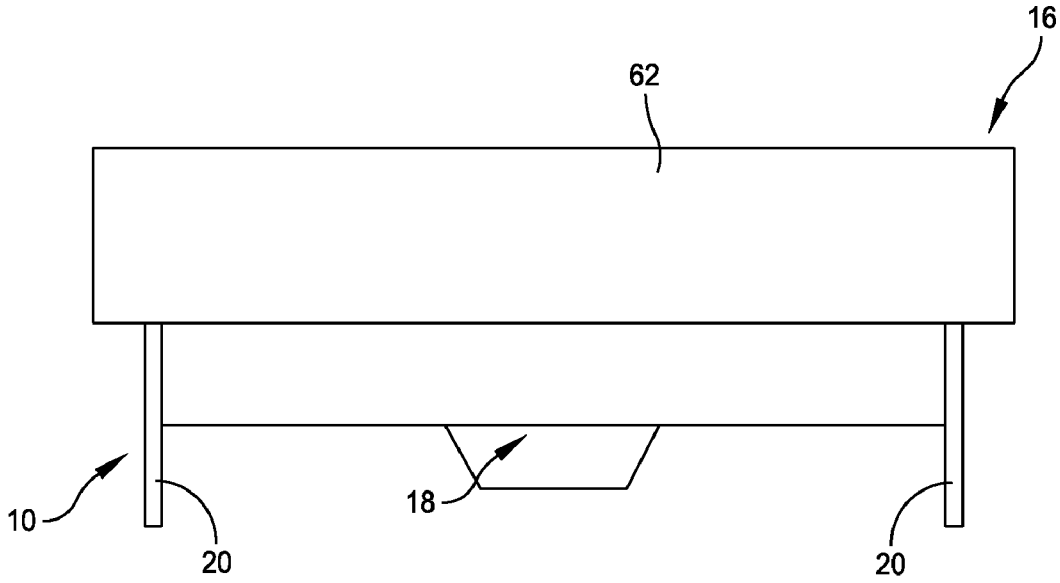
FIG. 4 is a top view of the roller device frame.
Figure 5:
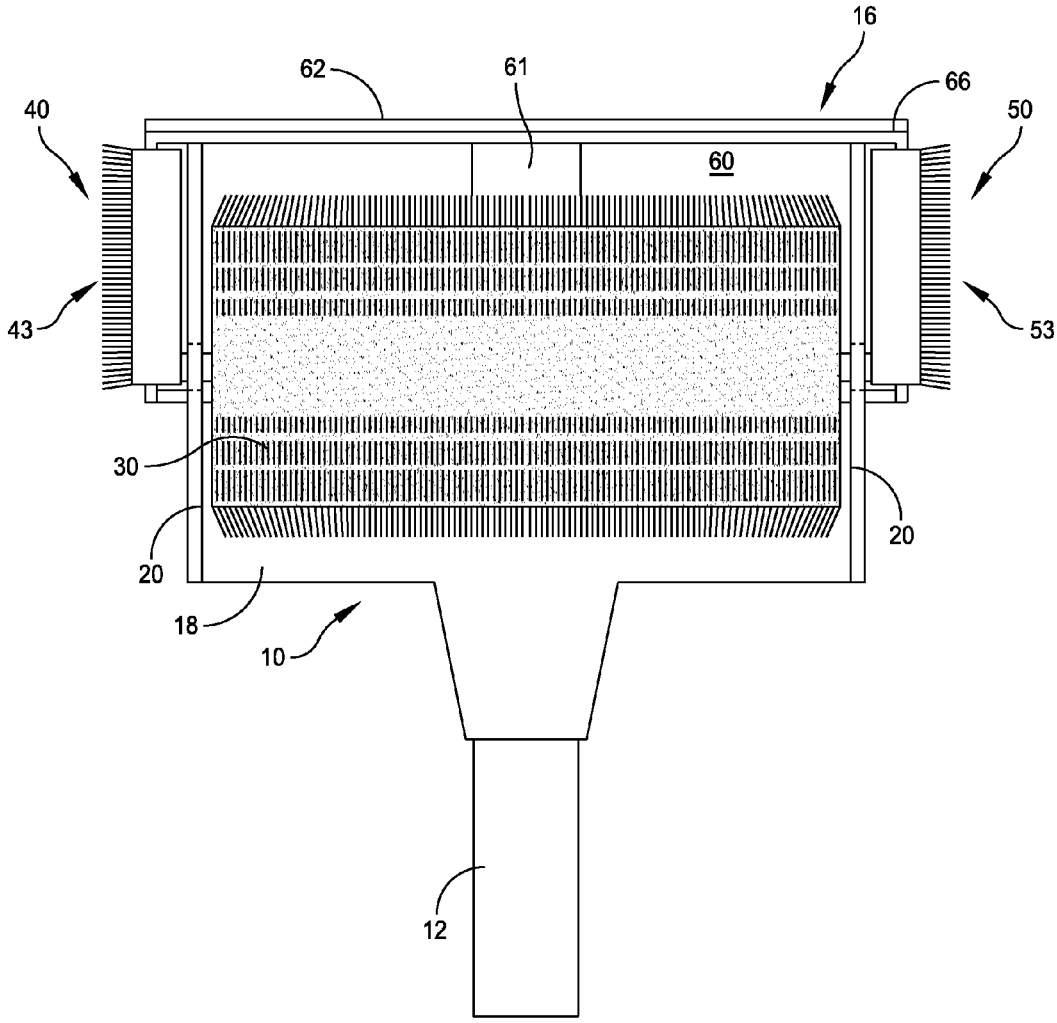
FIG. 5 is a front view of a preferred embodiment of the painting device with the added roller and pad structure.
Figure 6:
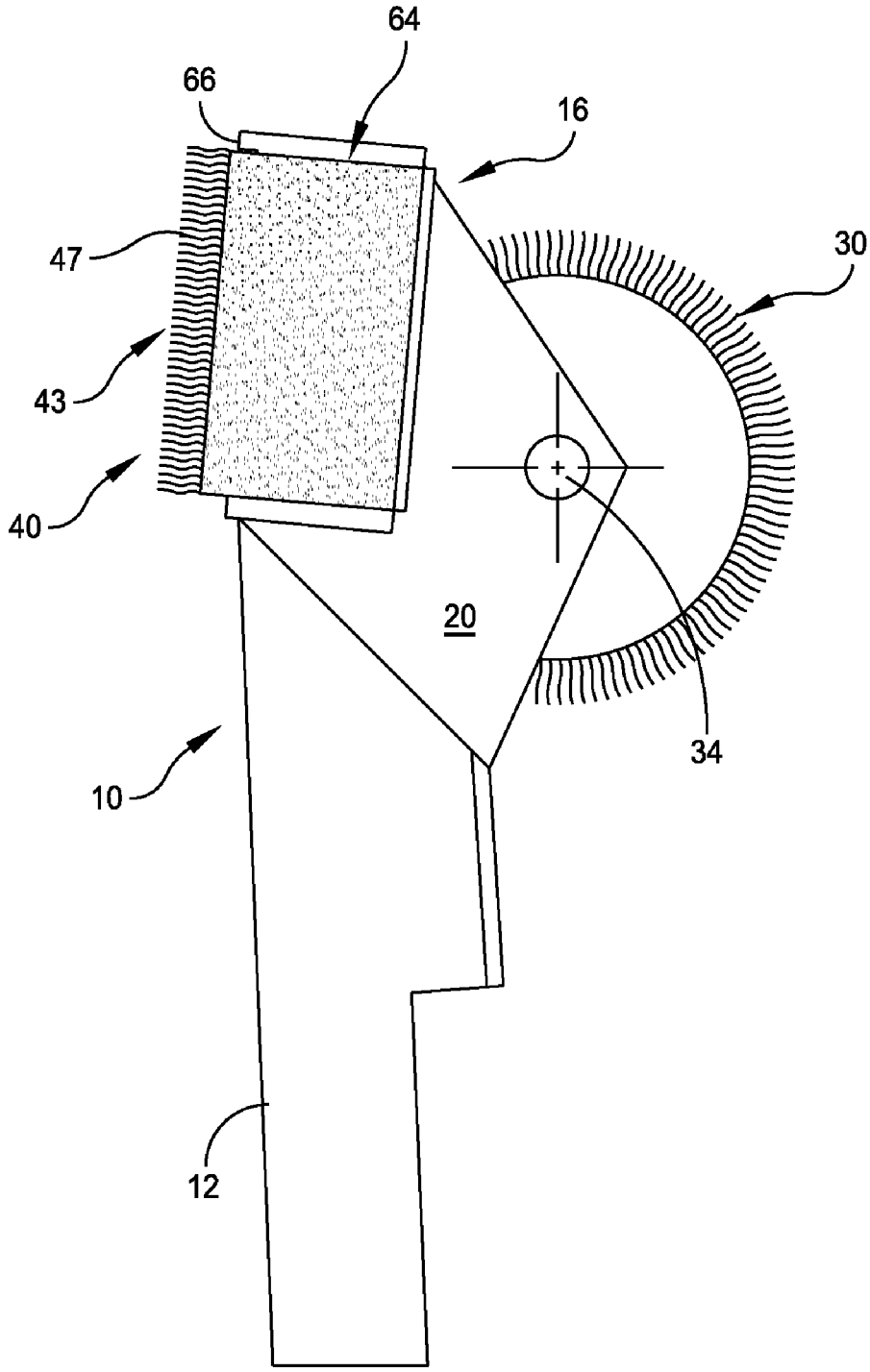
FIG. 6 is a left side view of the painting device with the added roller and pad structure.
Figure 7:
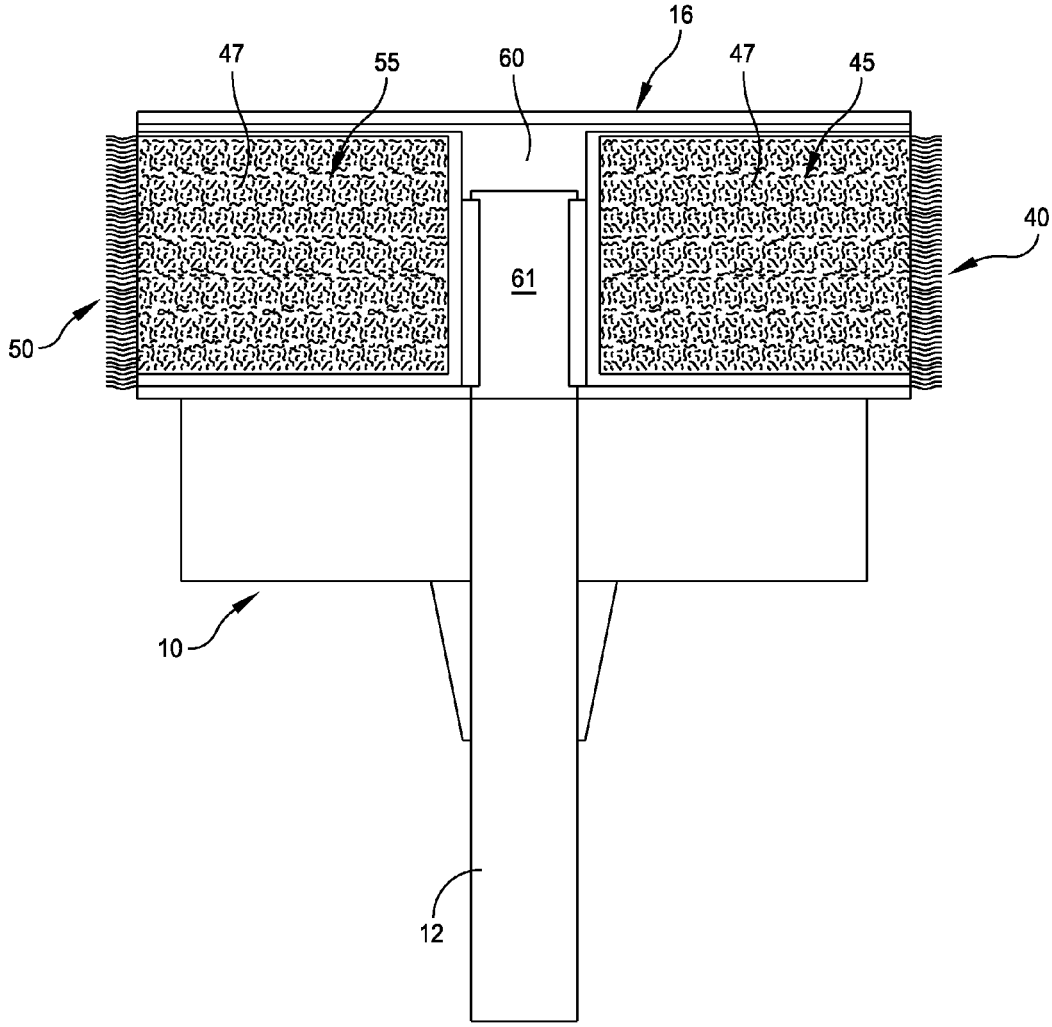
FIG. 7 is a rear view of the painting device with the added roller and pad structure.
Figure 8:
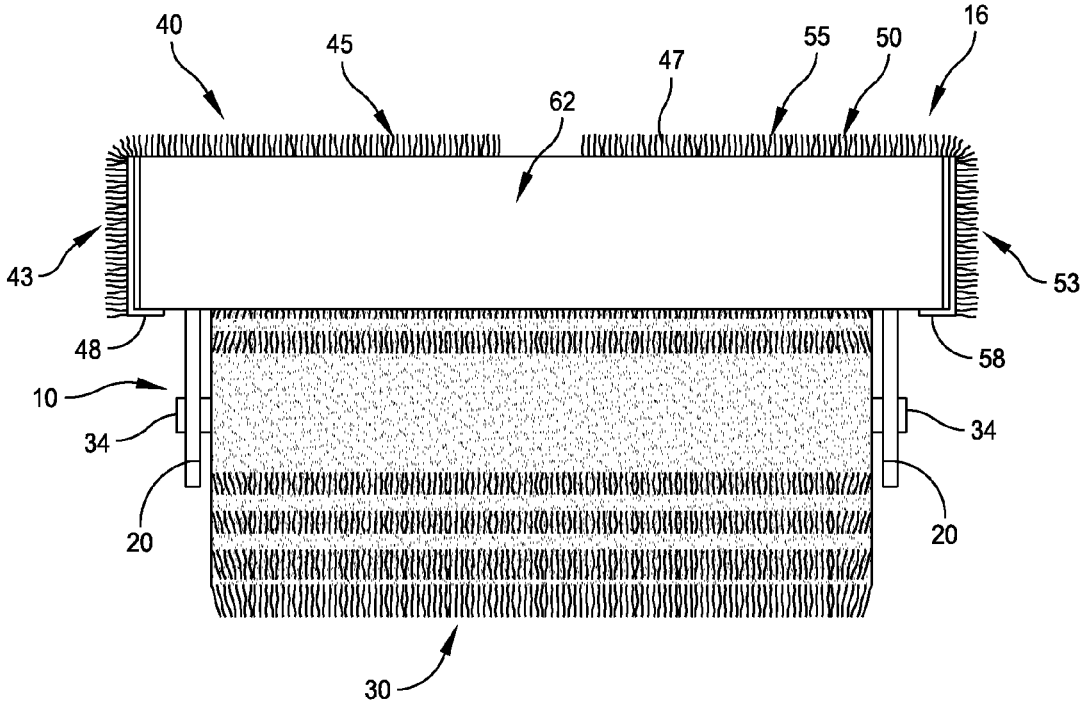
FIG. 8 is a top view of the painting device with the added roller and pad structure.
Figure 9:
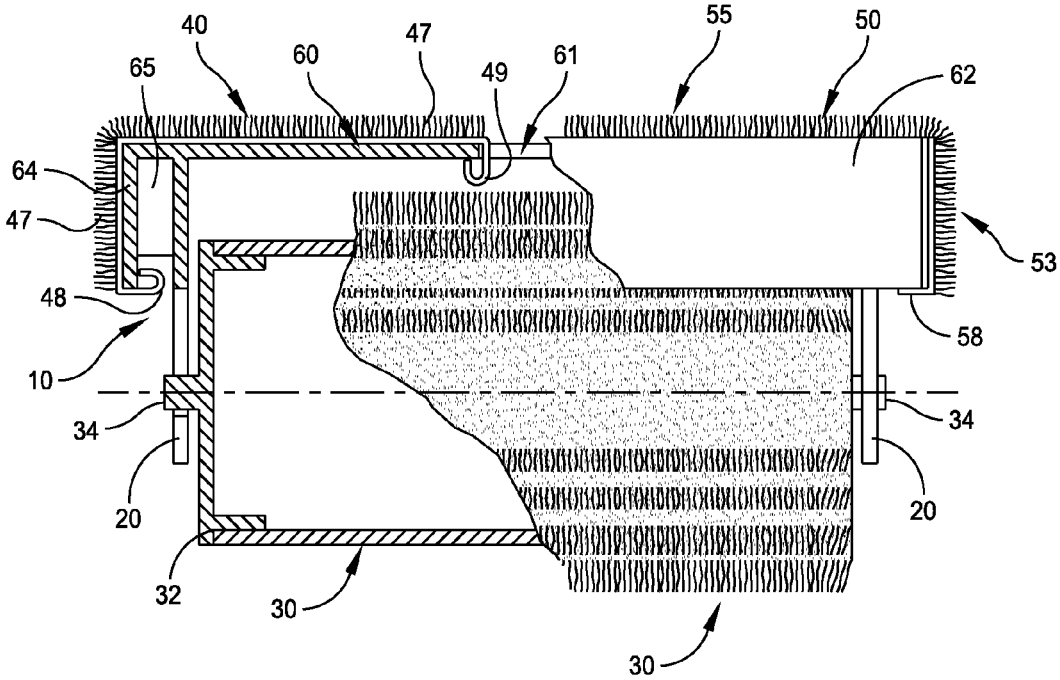
FIG. 9 is a top view similar to that shown in FIG. 8 but with portions of the structure cut away to illustrate further details.
Figure 10:
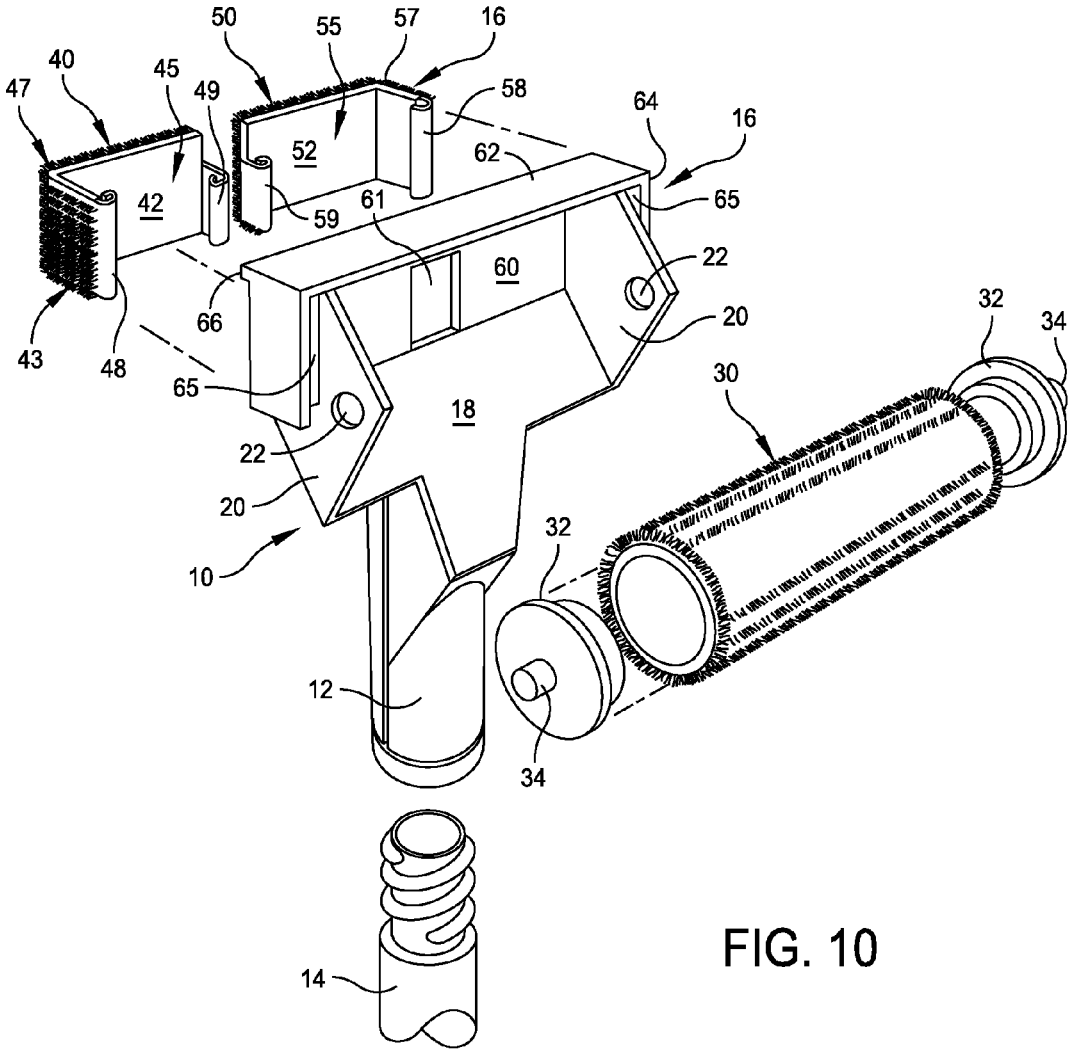
FIG. 10 is an exploded perspective view of the painting device of the present invention.

Reference is now made to the drawings and in particular to FIGS. 1-4. FIGS. 1-4 illustrate the basic frame construction. This is preferably constructed of a hard plastic material. FIGS. 5-8 illustrate various views also of the frame but with the roller and pad structures supported by the frame. FIG. 9 is a partially cut away front view illustrating further details and FIG. 10 is an exploded perspective view. The roller itself may be of conventional design as is presently used with a standard handle that is used in the industry. The pad structures are particularly designed for use in accordance with the present invention.

The painting device is comprised of a frame 10 that includes a handle 12. The handle 12 may be square, rectangular or circular in cross-section. In FIG. 10 the handle 12 is illustrated as of cylindrical shape and has an internally threaded port for receiving a threaded end of a pole 14 that can be used as an extension for the painting device. The frame 10 also generally includes a support end 16 that is integral with the handle 12 and that is for support of the roller 30 on one side thereof and support, on the other side thereof, a pair of paint pad members 40 and 50. Both the roller 30 and paint pad members 40 and 50 are interlocked with the frame in a readily releasable manner so that they can be changed or removed to be cleaned.

The frame 10 includes at its support end 16, a slanted wall 18 that has a pair of spacedly disposed flanges 20 extending therefrom. The flanges 20 are the basic means for retaining the roller 30. For this purpose, the roller 30 is provided with end pieces 32 each having an end post 34 that is for engagement in a hole 22 in the respective flanges 20. For this purpose, the flanges 20 are preferably somewhat deflectable so that sufficient space can be provided between the flanges for engagement of the posts 34 in the holes 22. Each of the end pieces 32 has a smaller diameter portion that is adapted to snugly fit within the end of each roller. FIG. 10 shows the pieces 32 exploded away from the roller 30 while FIG. 9, for example, illustrates one of the end pieces 32 engaged in the roller 30 with the post 34 disposed in the hole 22 of the flange 20.

The other side of the support end 16 of the frame is for support of the paint pad members 40 and 50. For this purpose there is provided a rear wall 60, a top wall 62 and opposite side walls 64. The side walls 64 extend toward the front, toward flange 20 leaving an engagement channel 65 for engagement on either side with the respective pair of pad members 40 and 50. Also the top wall 62 extends rearwardly to define a rear edge 66. See also the left-side view of FIG. 2. The edge 66 is disposed adjacent to the pad members 40 and 50 and provides a convenient edge when the pads are used in inwardly facing corners such as at an area where two walls join in a room, or at the baseboard of a wall.

Each of the paint pad members 40 and 50 includes a relatively rigid base member 42, 52. In this regard refer to the exploded perspective view of FIG. 10. It is noted that each of these bases 42, 52 are constructed with a right angle turn and thus each includes a side section 43, 53 and a corresponding rear section 45, 55. Over each of these right angle base layers is provided a fabric layer 47, 57. The material of 47, 57 is conventional material that is presently used in planar paint pad structures. This material is absorbent to paint and may be provided in different levels of nap.

In order to hold the two paint pad members 40 and 50 in place, there is provided a means for retaining them to the frame. For this purpose, the wall 60 is provided with a central aperture 61. In this connection refer to FIGS. 7, 9 and 10. In particular, FIG. 9 shows the manner in which one of the pad members, namely, pad member 40 is engaged with the frame.

Each of the pad members 40 and 50 have respective end ribs. Thus, pad 40 has end ribs 48 and 49, while pad 50 has end ribs 58 and 59. These ribs are clearly illustrated in the exploded perspective view of FIG. 10. Also, refer to the cutaway top view of FIG. 9 that illustrates the end ribs 48 and 49. The more centrally disposed ribs 49, 59 are engaged at the aperture 61 in the wall 60. Once again, FIG. 9 illustrates the left hand pad member 40 with its rib 49 engaged in a side edge of the aperture 61. The outer ribs 48, 58 are engaged with respective channels 65. This is also clearly illustrated in the cutaway view of FIG. 9 that illustrates, in connection with pad member 40, the end rib 48 that engages with the channel 65. The opposite pad member 50 is engaged in the same manner with the opposite channel 65. Refer also to the front view of FIG. 1 that illustrates the frame without the pads mounted but certainly illustrates the opposite side channels 65. The pad members 40 and 50 have sufficient flexibility so that they can be readily snapped in place with the central ribs engaging with the aperture 64 and with the outer respective ribs engaging with the respective channels 65. The pad members can also readily be removed by, for example, pressing on the ribs 49, 59 to disengage with the central aperture 61.

One of the important features of the present invention is the ability to be able to simply reverse the frame basically through 180 degrees so as to change from the roller side to the pad side. On the roller side the user can engage the handle with the roller facing toward the wall surface that is to be rolled. For doing cornering and edging, then the user simply rotates the frame so that the pad side is facing the wall surface. The right angle pad members are quite convenient for doing inner corners. The edge 66 is useful in providing an edger so that the pad members can be used to apply paint very close to a baseboard or a ceiling area. Both the roller and pad pieces can be readily inserted into the frame and also easily removed from the frame for the purpose of being discarded or cleaned. When the pad side is being used, the slanted surface 18 is helpful in that the user can use the thumb on that surface while the remainder of the hand is about the handle. This provides a convenient way for guiding the pad side of the painting device. When using the roller side against the wall, basically the user need only grasp the handle 12.

Having now described a limited number of embodiments of the present invention, it should now be apparent to those skilled in the art that numerous other embodiments and modifications thereof are contemplated as falling within the scope of the present invention as defined by the appended claims. One variation of the present invention can involve the roller 30. Instead of providing end posts on the roller, the flanges could be provided with a post and the end pieces of the roller could be provided with a hole.

What is claimed is:

1. A painting device for applying a paint product and comprising:

a frame that includes a handle end and a support end that has one and another sides;

the one side of the support end of the frame including spaced apart flanges that retain therebetween a paint roller;

the another side of the support end of the frame including a wall member and opposed end wall surfaces that together retain thereon a paint pad means;

wherein the end wall surfaces of the another side both extend at a right angle to the plane of the wall member;

wherein the paint pad means comprises a pair of paint pads, each including a right angle bend forming respective back and side pad sections;

wherein each paint pad has end engagement ribs, one rib on a free end of the back pad section and another rib on a free end of the side pad section;

wherein the wall member has a central aperture for receiving respective one ribs of the pair of paint pads at opposed side edges of the central aperture;

wherein the opposed end wall surfaces of the support end of the frame each have engagement ledges for receiving respective another ribs of the side pad sections;

wherein each of the paint pads includes a base member and a paint absorption layer attached to the base member;

and wherein the base member of the back pad section of both pads is for support against a back surface of the wall member of the frame and the base member of the side pad section of both pads is for support against respective end wall surfaces.

2. The painting device of claim 1 wherein the flanges each have a hole therein for receiving end posts of the paint roller.

3. The painting device of claim 1 including, on the one side of the support end, a tapered wall surface that is contiguous with the handle and to which are attached the spaced apart flanges at end thereof.

4. The painting device of claim 3 wherein the tapered wall surface has a top end that extends between the flanges and a smaller bottom end that merges with the handle.

5. The painting device of claim 1 wherein the aperture is a single aperture with the side edges thereof extending orthogonal to the plane of the wall member.

6. The painting device of claim 1 wherein each of the ledges is formed at least in part by a channel.

7. The painting device of claim 6 wherein the aperture is rectangular in shape.

8. The painting device of claim 7 wherein the another side of the support frame also has a top wall integral with the wall member and orthogonal to the wall member.

9. The painting device of claim 6 wherein one side of each channel is formed by a corresponding flange.

10. The painting device of claim 9 including, on the one side of the support end, a tapered wall surface that is contiguous with the handle and to which are attached the spaced apart flanges at ends thereof.

11. The painting device of claim 1 including a top wall of the support end of the frame having a projecting edge.

12. The painting device of claim 1 wherein each of the flanges extend in parallel with the respective end wall surfaces.

13. The painting device of claim 1 wherein each of the flanges extends orthogonal to the plane of the wall member.

* * * * *